US011143044B2

(12) United States Patent
Prestel et al.

(10) Patent No.: US 11,143,044 B2
(45) Date of Patent: Oct. 12, 2021

(54) INTER-TURBINE CASING COMPRISING MOUNTED SPLITTER BLADES

(71) Applicant: SAFRAN AIRCRAFT ENGINES, Paris (FR)

(72) Inventors: Sébastien Jean Laurent Prestel, Moissy-Cramayel (FR); Simon Jean-Marie Bernard Cousseau, Moissy-Cramayel (FR); Alice Pages, Moissy-Cramayel (FR); Cyril Verbrugge, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/965,433

(22) PCT Filed: Jan. 25, 2019

(86) PCT No.: PCT/FR2019/050164
§ 371 (c)(1),
(2) Date: Jul. 28, 2020

(87) PCT Pub. No.: WO2019/145648
PCT Pub. Date: Aug. 1, 2019

(65) Prior Publication Data

US 2021/0054752 A1 Feb. 25, 2021

(30) Foreign Application Priority Data

Jan. 29, 2018 (FR) ..... 1850672

(51) Int. Cl.
*F01D 9/04* (2006.01)
*F01D 25/24* (2006.01)

(52) U.S. Cl.
CPC ..... *F01D 9/042* (2013.01); *F01D 9/041* (2013.01); *F01D 25/24* (2013.01); *F05D 2220/32* (2013.01); *F05D 2240/12* (2013.01)

(58) Field of Classification Search
CPC ..... F01D 9/041; F01D 9/042; F01D 25/24; F01D 25/243; F01D 25/246; F05D 2220/32; F05D 2240/12; F05D 2260/36
See application file for complete search history.

(56) References Cited

U.S. PATENT DOCUMENTS

2010/0111690 A1* 5/2010 Heriz Agiriano ..... F01D 25/162 415/229
2015/0044032 A1* 2/2015 Paradis ..... F01D 25/246 415/134

(Continued)

FOREIGN PATENT DOCUMENTS

EP 2182177 A2 5/2010
EP 2835503 A1 2/2015

(Continued)

OTHER PUBLICATIONS

International Search Report for PCT/FR2019/050164 dated Jun. 19, 2019 [PCT/ISA/210].

(Continued)

*Primary Examiner* — Igor Kershteyn
(74) *Attorney, Agent, or Firm* — Sughrue Mion, PLLC

(57) ABSTRACT

The invention relates to an inter-turbine casing (1) comprising: an inner shell (10), an outer shell (20), and an assembly of arms (2) extending radially between the timer (10) and outer (20) shells; and an assembly of splitter blades (30) positioned between the arms (2), each splitter blade (30) comprising an inner platform (33) and an outer platform (36). The inner shell (10) comprises at least one inner groove (11) for slidably receiving one or more inter platforms (33). The outer shell (20) comprises at least one outer groove (21)

(Continued)

for slidably receiving one or more outer platforms (36). The inter-turbine casing further comprises locking means (4, 5) for locking the splitter blades (30) in the inner (11) and outer (21) grooves. The splitter blades are arranged using multiple tenons (39) that extend in corresponding ribs (12, 22).

9 Claims, 3 Drawing Sheets

(56) References Cited

U.S. PATENT DOCUMENTS

| | | | | |
|---|---|---|---|---|
| 2015/0098812 | A1* | 4/2015 | Paradis | F01D 9/042 415/209.3 |
| 2018/0066531 | A1* | 3/2018 | Paradis | F01D 9/042 |

FOREIGN PATENT DOCUMENTS

| | | | |
|---|---|---|---|
| EP | 2860354 | A1 | 4/2015 |
| GB | 1058759 | A | 2/1967 |

OTHER PUBLICATIONS

French Preliminary Search Report dated Sep. 27, 2018, in application No. FR1850672.

* cited by examiner

INTER-TURBINE CASING COMPRISING MOUNTED SPLITTER BLADES

CROSS REFERENCE TO RELATED APPLICATIONS

This application is a National Stage of International Application No. PCT/FR2019/050164 filed Jan. 25, 2019, claiming priority based on French Patent Application No. 1850672 filed Jan. 29, 2018, the entire contents of each of which incorporated by reference herein in their entireties.

FIELD OF THE INVENTION

The invention generally relates to a turbomachine, in particular a bypass turbomachine, and more particularly to an inter-turbine casing of the turbine vane frame type performing the function of turbine distributor in such a turbomachine.

TECHNOLOGICAL BACKGROUND

A bypass turbomachine generally comprises, from upstream to downstream in the gas flow direction, a fan, an annular primary flow path and an annular secondary flow path. The mass of air suctioned by the fan is thus divided into a primary flow, which circulates in the primary flow path, and a secondary flow, which is concentric with the primary flow and circulates in the secondary flow path.

The primary flow path passes through a primary body comprising one or more stages of compressors, for example a low pressure compressor and a high pressure compressor, a combustion chamber, one or more stages of turbines, for example a high pressure turbine and a low pressure turbine, and a gas exhaust nozzle.

In a manner known per se, the turbomachine also comprises an inter-turbine casing, the hub of which is arranged between the high-pressure turbine casing and the low-pressure turbine casing. The inter-turbine hub comprises a fairing including an inner shroud and an outer shroud, which together delimit the flow path between the high-pressure turbine and the low-pressure turbine, as well as arms which radially extend between the inner shroud and the outer shroud.

The fairing may have a single profile configuration and only include arms. Alternatively, the fairing may have a multi-profile configuration and include, in addition to the arms, splitter blades (or splitters). In this case, one or more splitter blades are interposed between the arms and have a small cord compared to the arms, which are thicker and have a long cord. It is understood by cord here that the segment connecting the leading edge and the trailing edge of the arm or the splitter blade at its junction with the outer shroud.

The single profile configuration is more conventional and easier to manufacture. However, the integration of the arms can be difficult since the need for deflection of the gas flow by the arms can lead to strongly curved aerodynamic profiles. In the multi-profile configuration, the deflection of the gas flow is performed via the downstream part of the arms and the splitter blades, which allows maintaining an almost symmetrical profile in the upstream part of the arms. In addition, the multi-profile configuration has significant aerodynamic optimization potential since it includes a large number of parameters that can be adjusted as required. However, a fairing having a multi-profile configuration is more difficult to achieve. Generally, it is obtained either from casting or by, mounting the splitter blades.

Documents EP 2 860 354, EP 2 835 503 and GB 1 058 759 describe an inter-turbine casing for a turbomachine comprising an inner shroud, an outer shroud, a set of arms and a set of splitter blades mounted on the inner shroud and the outer shroud downstream of the arms.

SUMMARY OF THE INVENTION

A purpose of the invention is to provide an inter-turbine casing for a multi-profile type turbomachine which is easy to produce at a moderate cost and whose maintenance is facilitated in comparison with conventional inter-turbine casings.

For this purpose, the invention proposes an inter-turbine casing for a turbomachine comprising:

- an inner shroud, an outer shroud and a set of arms extending radially between the inner shroud and the outer shroud, the inner shroud and the outer shroud extending coaxially around a longitudinal axis,
- a set of splitter blades positioned circumferentially between the arms, each splitter blade comprising a root provided with an inner platform fixed to the inner shroud and a head provided with an outer platform fixed to the outer shroud.

The inner shroud comprises at least one inner groove configured to slidingly receive one or more inner platforms. The outer shroud comprises at least one outer groove configured to slidingly receive one or more outer platforms. Moreover, the inter-turbine casing further comprises means for blocking the splitter blades in the inner and outer grooves.

Some preferred but non-limiting features of the inter-turbine casing described above are the following, taken individually or in combination:

- at least one rib is formed in each inner groove and each outer groove, each inner platform and each outer platform comprising a stud protruding from said platforms configured to penetrate into the rib of the inner groove or of the corresponding outer groove in order to radially block the splitter blades in said inner and outer grooves.
- each inner platform and each outer platform has an upstream face and a downstream face and comprises two studs, a first one of the studs extending from the upstream face while the second one of the studs extends from the downstream face, and in which each inner groove and each outer groove has an upstream border and a downstream border, a rib being formed in each upstream border and in each downstream border and being configured to receive an associated stud.
- the blocking means comprise: a set of orifices formed in the inner shroud and the inner platforms and a set of anti-rotation pins, each anti-rotation pin being inserted, on the one hand, into an orifice of the inner shroud and into an orifice of an inner platform, and a set of orifices formed in the outer shroud and the outer platforms and a set of anti-rotation pins, each anti-rotation pin being inserted, on the one hand, into an orifice of the outer shroud and into a orifice in an outer platform.
- the arms are formed integrally and in one-piece with the inner shroud and the outer shroud.
- the arms extend over a greater length than the splitter blades in the direction of the longitudinal axis.
- each arm and each splitter blade has a cord, the cord of the arms being larger than the cord of the splitter blades.
- the inter-turbine casing is sectored so that the inner shroud and the outer shroud each comprise a plurality of ring sectors.

each ring sector of the inner shroud and of the outer shroud includes axial edges, each axial edge being configured to be fixed opposite an associated axial edge of another ring sector of the inner shroud or of the outer shroud, and in which the inner grooves and the outer grooves of each ring sector of the inner shroud and of the outer shroud open onto an axial edge of said ring sector. And/or the inter-turbine casing comprises a single arm formed integrally and in one-piece with one of the ring sectors of the inner shroud and one of the ring sectors of the outer shroud and at least two splitter blades, preferably three splitter blades.

BRIEF DESCRIPTION OF THE DRAWINGS

Other features, purposes and advantages of the present invention will appear better upon reading the detailed description which follows, and with reference to the appended drawings given by way of non-limiting examples and in which.

DETAILED DESCRIPTION OF AN EMBODIMENT

Figure 1:
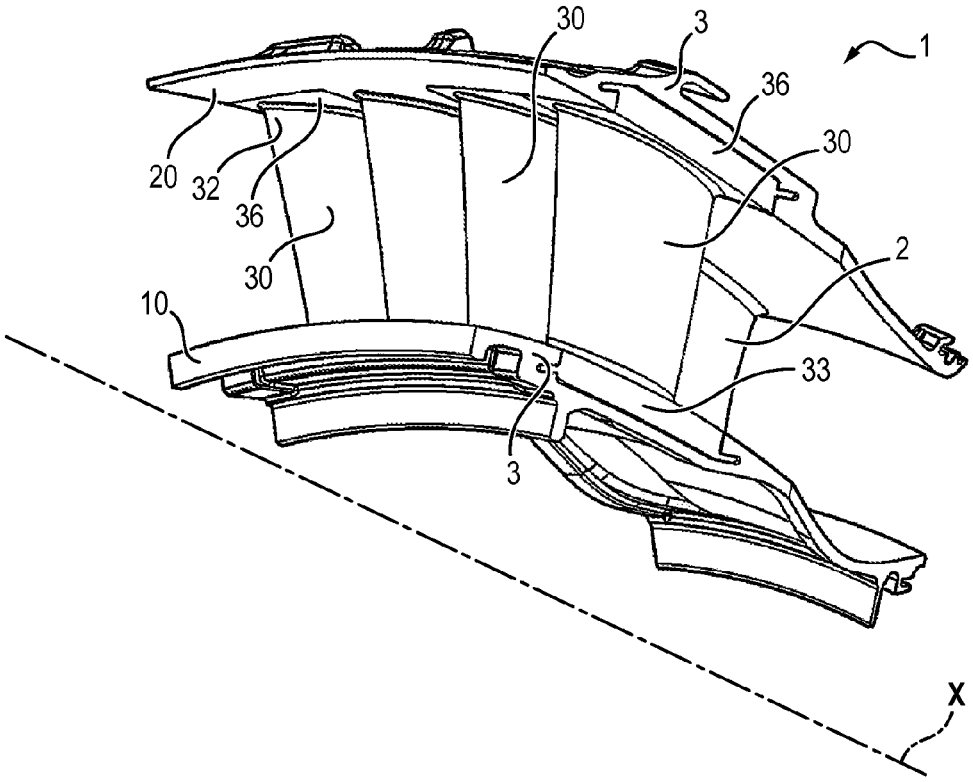
FIG. 1 is a perspective view from downstream of an example of an inter-turbine casing sector in accordance with the invention comprising an arm and three splitter blades.

An inter-turbine casing 1 according to the invention comprises:

an inner shroud 10, an outer shroud 20 and a set of arms 2 extending radially between the inner shroud 10 and the outer shroud 20. The inner shroud 10 and the outer shroud 20 extend coaxially around a longitudinal axis X.

a set of splitter blades 30 comprising a root 31 fixed to the inner shroud 10 and a head 32 fixed to the outer shroud 20.

The splitter blades 30 are positioned circumferentially between the arms 2. Particularly, one or more splitter blades 30 can extend between two adjacent arms 2. It will be noted that, conventionally, the cord of each splitter blade 30 is shorter than the cord of each arm 2. Moreover, each splitter blade 30 comprises an inner platform 33 fixed on its root 31 and an outer platform 36 fixed on its head 32.

The inner shroud 10 comprises at least one inner groove 11 configured to slidingly receive one or more inner platforms 33 and the outer shroud 20 comprises at least one outer groove 21 configured to slidingly receive one or more outer platforms 36.

Finally, the inter-turbine casing 1 comprises means 4, 5 for blocking the splitter blades 30 in the grooves.

In this description, a part will be designated by "inner" as opposed to "outer" when this part is close to the longitudinal axis X (as opposed to far from the longitudinal axis X). An axis or a direction extending in a plane normal to the longitudinal axis X and intersecting this longitudinal axis X will be designated by "radial". An axis or a direction which is parallel to the longitudinal axis X will be designated by "axial".

Finally, the upstream and downstream are defined relative to the direction of gas flow in the inter-turbine casing.

The splitter blades 30 are therefore mounted and fixed on the rest of the inter-turbine casing 1 via their inner platform 33 and their outer platform 36, which allows simplifying the manufacture of the inter-turbine casing 1 as well as the maintenance operations.

Indeed, it suffices to slide the splitter blades 30 into the inner and outer grooves 11, 21 associated with the inner and outer shrouds 10, 20 in order to position said splitter blades 30, then to fix them in this position to the rest of the inter-turbine casing 1 using the blocking means 4, 5.

Once the splitter blades 30 in place in the inner and outer grooves 11, 21, the radially outer face 33*a* of the inner platforms 33 and the radially inner face 36*a* of the outer platforms 36 extend in the continuation of the inner shroud 10 and the outer shroud 20 so as to reconstitute the flow path. Furthermore, the inner and outer platforms 33, 36 completely fill the inner and outer grooves so as not to leave a cavity capable of creating pressure drops.

In order to facilitate the production of the inter-turbine casing 1, the latter can be sectored, that is to say that the inner shroud 10 and the outer shroud 20 can each be formed of several ring sectors, each ring sector carrying one or more arms 2. Then, each ring sector comprises two axial edges 3 and are fixed together in pairs at their axial edges 3 in order to form the inner shroud 10 and the outer shroud 20.

The inner and outer grooves 11, 21 each open onto one of the axial edges 3 of the ring sectors forming the inner and outer shrouds 10, 20 in order to allow the insertion of the inner and outer platforms 33, 36 into the associated inner and outer 11, 21 grooves.

Figure 2:
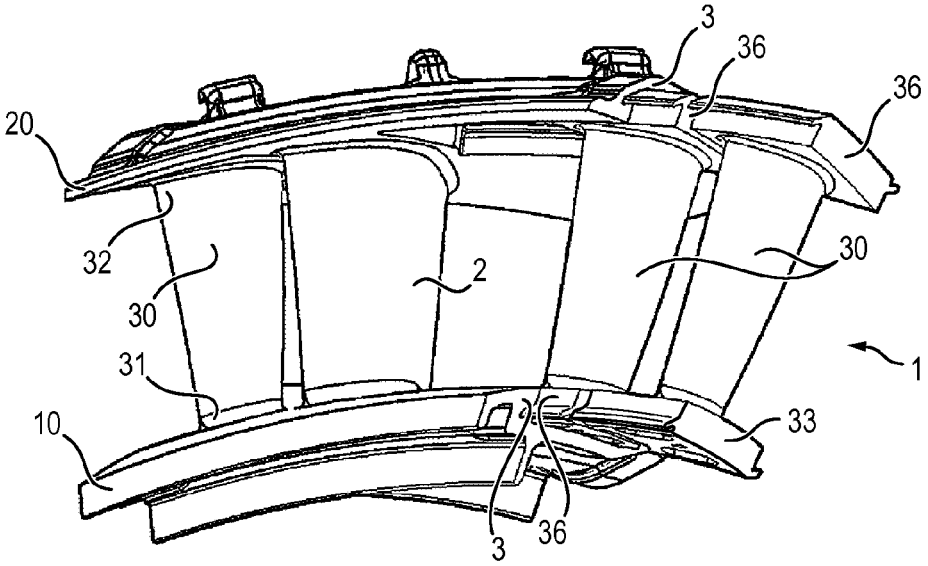
FIG. 2 is a perspective view from downstream illustrating the mounting of two of the splitter blades of the inter-turbine casing sector of FIG. 1.
Figure 3A:
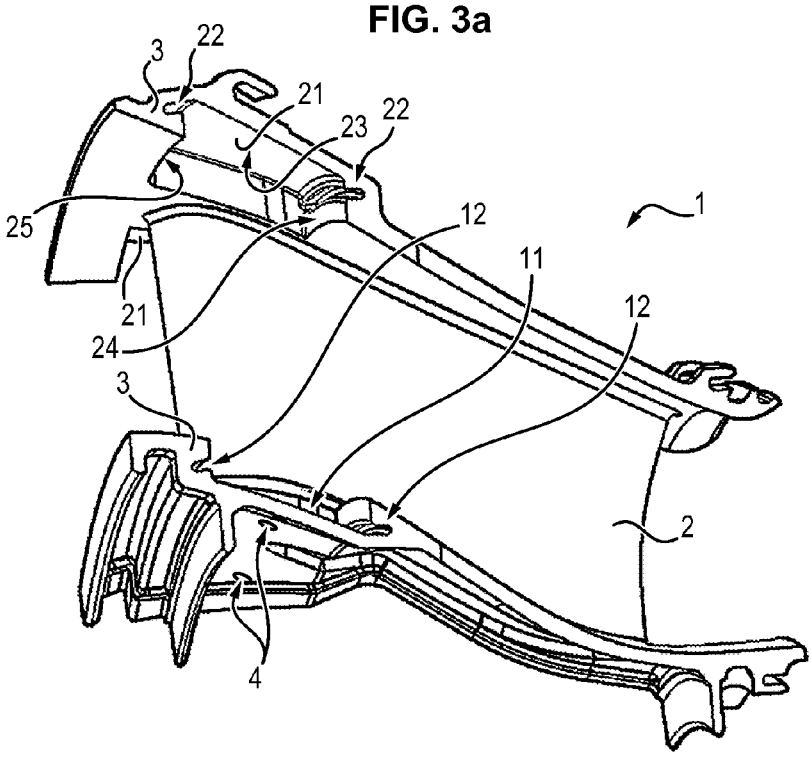
FIG. 3*a* is a bottom view of the inter-turbine casing sector of FIG. 1 without the splitter blades.
Figure 3B:
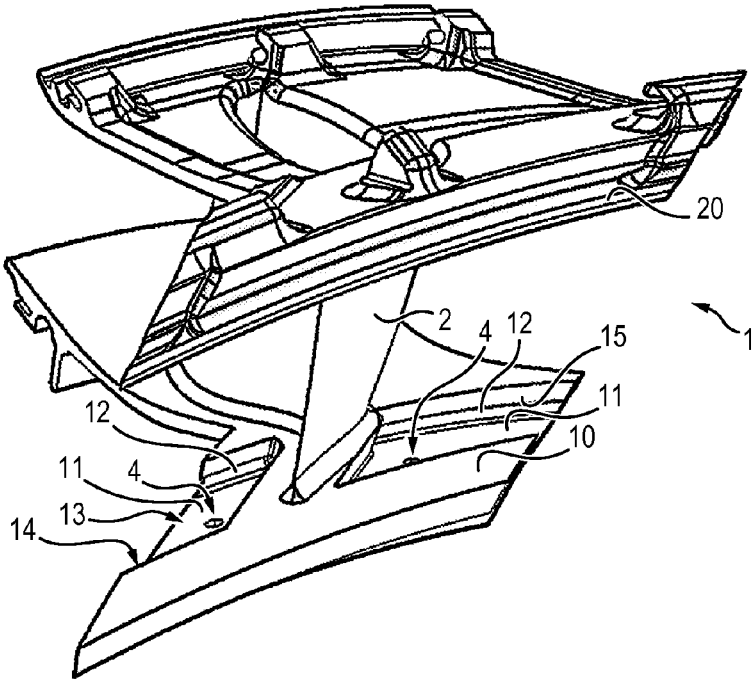
FIG. 3*b* is a top view of the inter-turbine casing sector of FIG. 1 without the splitter blades.

Preferably, each ring sector includes only one arm 2. However, each ring sector can comprise two inner grooves 11 (respectively, two outer grooves 21) extending on either side of the associated arm 2 (see for example FIG. 3*b*). Each groove then opens into the associated axial edge 3. It will be noted that the same groove can, however, receive several splitter blades 30. For example, FIGS. 1 and 2 illustrate an example of an inter-turbine casing sector comprising an arm surrounded on one side by a splitter blade 30 and on the other side by two splitter blades 30.

At least one rib 12, 22 is formed in each inner groove 11 and each outer groove 21 while each inner platform 33 and each outer platform 36 comprises an associated stud 39.

More specifically, each inner groove 11 (respectively, each outer groove 21) is delimited by an inner wall 13 (respectively an outer wall 23) and a peripheral border including an upstream border 14, 24 and a downstream border 15, 25. A rib 12, 22 is formed both in the upstream border 14, 24 and in the downstream border 15, 25 of the inner groove 11 (respectively, of the outer groove 21) by opening at one of the axial edges 3 of the inner groove 11 (respectively, of the outer groove 21).

Moreover, the inner platform 33 (respectively, the outer platform 36) of the splitter blades 30 has an upstream face 34, 37 configured to be opposite the upstream border 14 of the inner groove 11 (respectively, of the outer groove 21) and a downstream face 35, 38 configured to be opposite its downstream border 15. It further includes a stud 39 protruding from the upstream face 34 of the inner platform (respectively, the upstream face 37 of the outer platform 36) and configured to slide in the rib 12, 22 of the upstream border 14, 24, as well as a stud 39 protruding from the downstream face 35 of the inner platform 33 (respectively, the downstream face 38 of the outer platform 36) and configured to slide in the rib 12, 22 of the downstream border 15, 25. The studs 39 and the associated ribs 12, 22 thus allow guiding the splitter blades 30 in the inner and outer grooves 11, 21 and preventing their radial displacement.

In order to allow the sliding of the splitter blades 30 relative to the inner shroud 10 and the outer shroud 20, the radial section of the inner and outer grooves 11, 21 is constant between the axial edges 3 of the ring sectors forming said shrouds 10, 20.

The blocking means 4, 5 are configured to block the splitter blades 30 in position once the latter are in place in the inner and outer grooves 11, 21.

For this purpose, the blocking means can comprise:

a set of orifices 4 formed in the inner shroud 10 and the inner platforms 33 and a set of anti-rotation pins 5, each anti-rotation pin being inserted, on the one hand, into an orifice 4 of the inner shroud 10 and into an orifice 4 of an inner platform 33, and a set of orifices formed in the outer shroud 20 and the outer platforms 36 and a set of anti-rotation pins, each anti-rotation pin 5 being inserted, on the one hand, into an orifice 4 of the outer shroud 20 and into an orifice 4 of an outer platform 36.

In the exemplary embodiment illustrated in the figures, an orifice 4 is formed in the inner shroud 10 and in the outer shroud 20 for each splitter blade 30. The inter-turbine casing 1 therefore comprises as many anti-rotation pins 5 as there are splitter blades 30.

In one embodiment, the orifices 5 are circular and have an axis of symmetry which is normal to the inner shroud 10 (respectively, to the outer shroud 20).

Figure 4:
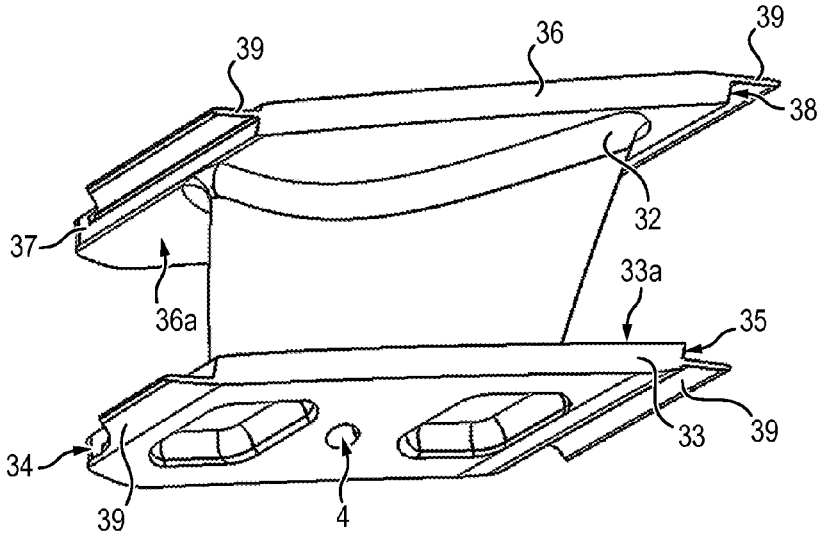
FIG. 4 is a perspective view of an exemplary embodiment of a splitter blade which can be used in an inter-turbine casing in accordance with the invention.
Figure 5:
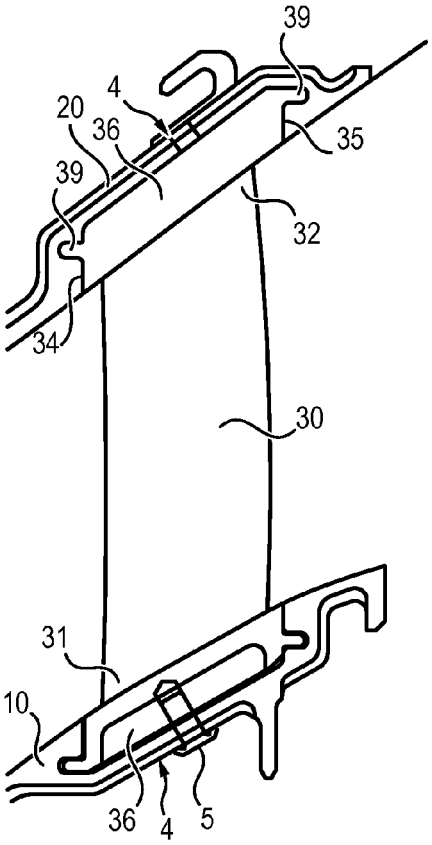
FIG. 5 is a sectional view of an exemplary embodiment of an inter-turbine casing at a splitter blade.

The arms 2 are in turn integrally formed with the inner shroud 10 and the outer shroud 20 (or at least with the ring sector of the inner shroud 10 and the outer shroud 20 to which they are fixed). For this purpose, the arms 2 can be integrally cast with the inner shroud 10 and the outer shroud 20. Alternatively, the arms 2 can be mounted and fixed on the inner shroud 10 and the outer shroud 20.

Where appropriate, the radially inner face of the inner platform 33 and the radially outer face of the outer platform 36 can be locally hollowed out in order to reduce the overall weight of the inter-turbine casing 1, except in the area in which is formed the orifice (see FIG. 4).

The invention claimed is:

1. An inter-turbine casing for a turbomachine comprising:

an inner shroud, an outer shroud and a plurality of arms extending radially between the inner shroud and the outer shroud, the inner shroud and the outer shroud extending coaxially around a longitudinal axis;

a plurality of splitter blades positioned circumferentially between the arms, each splitter blade comprising a root provided with an inner platform fixed to the inner shroud and a head provided with an outer platform fixed to the outer shroud;

wherein the inner shroud comprises at least one inner groove configured to slidingly receive one or more inner platforms and the outer shroud comprises at least one outer groove configured to slidingly receive one or more outer platforms;

the inner platform and the outer platform of the splitter blades each have an upstream face and a downstream face and each comprise two studs, wherein a first stud of the two studs extends from the upstream face of the inner platform and of the outer platform and a second stud of the two studs extends from the downstream face of the inner platform and of the outer platform; and wherein each inner groove and each outer groove has an upstream border and a downstream border, a rib being formed in each upstream border and in each downstream border and being configured to receive the first stud or the second stud, respectively, to radially block the splitter blades in the inner grooves and in the outer grooves.

2. The inter-turbine casing according to claim 1, further comprising blocking means including:

a plurality of orifices formed in the inner shroud and in the inner platforms and a plurality of anti-rotation pins, each anti-rotation pin being inserted into an orifice of the inner shroud and into an orifice of the inner platform of one of the splitter blades; and a plurality of orifices formed in the outer shroud and in the outer platforms and a plurality of anti-rotation pins, each anti-rotation pin being inserted into an orifice of the outer shroud and into an orifice of the outer platform of one of the splitter blades.

3. The inter-turbine casing according to claim 1, wherein the arms are integrally formed with the inner shroud and the outer shroud.

4. The inter-turbine casing according to claim 1, wherein the arms extend over a length that is greater than a length of the splitter blades.

5. The inter-turbine casing according to claim 1, wherein a cord of the arms is larger than a cord of the splitter blades.

6. The inter-turbine casing according to claim 1, wherein the inter-turbine casing is sectored so that the inner shroud and the outer shroud each comprise a plurality of ring sectors.

7. The inter-turbine casing according to claim 6, wherein each ring sector of the inner shroud and each ring sector of the outer shroud includes axial edges, the axial edge of each ring sector of the inner shroud and of the outer shroud being configured to be fixed opposite the axial edge of another ring sector of the inner shroud and of the outer shroud, respectively, and wherein the inner grooves and the outer grooves open onto an axial edge of each ring sector.

8. The inter-turbine casing according to claim 6, wherein the inter-turbine casing comprises a single arm integrally formed with one of the ring sectors of the inner shroud and one of the ring sectors of the outer shroud and with at least two splitter blades, preferably three splitter blades.

9. The inter-turbine casing according to claim 6, wherein the inter-turbine casing comprises a single arm integrally formed with one of the ring sectors of the inner shroud and one of the ring sectors of the outer shroud and with three splitter blades.

* * * * *